US005704307A

United States Patent [19]

Treu et al.

[11] Patent Number: 5,704,307

[45] Date of Patent: Jan. 6, 1998

[54] TAUT LEG MOORING SYSTEM

[75] Inventors: Johannes Jacobus Treu, Bellville; Peter George Scott Dove, Houston, both of Tex.

[73] Assignee: Aker Marine, Inc., Houston, Tex.

[21] Appl. No.: 745,865

[22] Filed: Nov. 8, 1996

Related U.S. Application Data

[63] Continuation of Ser. No. 615,120, Mar. 21, 1996, abandoned.

[51] Int. Cl.[6] ..... B63B 21/00

[52] U.S. Cl. ..... 114/230; 114/293; 441/3

[58] Field of Search ..... 441/3–5; 114/230, 114/293, 294

[56] References Cited

U.S. PATENT DOCUMENTS

| | | | |
|---|---|---|---|
| 3,295,489 | 1/1967 | Bossa | 114/230 |
| 3,540,396 | 11/1970 | Horton | 114/230 |
| 3,602,174 | 8/1971 | Gorman | 441/4 |
| 3,703,151 | 11/1972 | Clement | 114/230 |
| 4,086,866 | 5/1978 | Nixon et al. | 114/295 |
| 4,257,721 | 3/1981 | Haynes | 405/227 |
| 4,318,641 | 3/1982 | Hogervorst et al. | 405/224 |
| 4,347,012 | 8/1982 | Glidden | 114/230 |
| 4,733,993 | 3/1988 | Andreasson | 405/224 |
| 5,041,038 | 8/1991 | Poldervaart et al. | 114/230 |
| 5,159,891 | 11/1992 | Lohr et al. | 114/230 |

OTHER PUBLICATIONS

Telefax memo from Applicant Aker Marine to Shell Offshore dated May 7, 1991.

Telefax memo from Applicant Aker Marine to Shell Offshore dated Jun. 17, 1991.

*Primary Examiner*—Stephen Avila

*Attorney, Agent, or Firm*—Michael A. O'Neil; Russell N. Rippamonti

[57] ABSTRACT

A taut leg bow mooring system (40) includes an anchor (42) positionable on the floor of the sea. A riser line (44) secured to and extending upwardly from the anchor, and a submerged buoy (46) secured to the end of the riser line from the anchor. The ratio of the net buoyancy of the surface buoy to the buoyancy of the submerged buoy is at least 2 to 1. A buoyant connector line (50) is secured to and extends upwardly from the submerged buoy. A surface buoy (52) is secured to the end of the connector line remote from the submerged buoy, and a hawser (56) is secured to and extends from the surface buoy.

20 Claims, 6 Drawing Sheets

TAUT LEG MOORING SYSTEM

RELATED APPLICATION

This application is a continuation application under 37 C.F.R. §1.53 of application Ser. No. 08/615,120 filed Mar. 21, 1996, abandoned.

TECHNICAL FIELD

This invention relates generally to systems for mooring supply boats and similar vessels relative to offshore drilling and/or production platforms and the like and, more particularly, to a taut leg bow mooring system for supply boats and similar vessels.

BACKGROUND OF THE INVENTION

Heretofore, supply boats and similar vessels have typically been moored to offshore drilling and/or production platforms and similar structures utilizing catenary-type mooring systems. Although adequate for shallow water applications, catenary-type mooring systems are unsatisfactory for use in deep water applications.

One problem associated with the use of catenary-type systems to effect bow mooring of supply boats and similar vessels involves the repetitive flexing of the components of the mooring system on or near the sea floor due to the action of tides, waves, currents, etc. The flexing of the component parts of a catenary-type mooring system results in increased wear, which in turn results in reduced service life of the system. This problem is compounded by the fact that the flexing of the component parts of a catenary-type mooring system is most pronounced in the components of the system situated near the sea floor. Thus, when a catenary-type mooring system is used in deep water, it is impossible for divers to descend deep enough to inspect and repair the component parts of the system which are the most subject to wear. Currently, a deep water catenary mooring system is typically inspected at 12 to 24 month intervals by retrieving the system, inspecting the system on board the retrieving vessel, and replacing worn components.

A more significant problem attendant to the use of catenary-type bow mooring systems in deep water applications involves the fact that catenary-type mooring systems do not provide sufficient stiffness to prevent the moored vessel from drifting too close to the adjacent structure. Because the catenary-type mooring system cannot apply sufficient force to keep the vessel properly positioned relative to the adjacent structure, the propulsion system of the vessel must be regularly used to keep the vessel clear of the adjacent structure. Present mooring systems are not satisfactory due to the increased costs of fuel consumption to operate the supply vessel's propulsion system and the risk of collision with the platform in case of a propulsion failure due to human error or equipment problems.

SUMMARY OF THE INVENTION

The present invention comprises a taut leg bow mooring system which overcomes the foregoing and other disadvantages associated with the prior art. In accordance with the broader aspects of the invention, a clump weight anchor is positioned on the sea floor. Other anchor types suitable for vertical loading may also be used. A riser wire extends upwardly from the anchor and is connected to a submerged buoy. A buoyant line extends from the submerged buoy to a surface buoy and a floating hawser extends from the surface buoy for connection to the anchor chain or bow mooring wire of a supply boat or similar vessel to be moored.

The use of the invention is advantageous in that taut leg mooring systems constructed in accordance therewith provide sufficient stiffness to eliminate the necessity of using the vessel propulsion system to keep the moored vessel clear of the adjacent structure in 6–8 foot seas. The use of the invention also eliminates the wear problems at the sea floor associated with the use of catenary-type mooring systems in deep water applications, and therefore extends the service life of the submerged part of the taut leg bow mooring to many times that of a catenary system.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
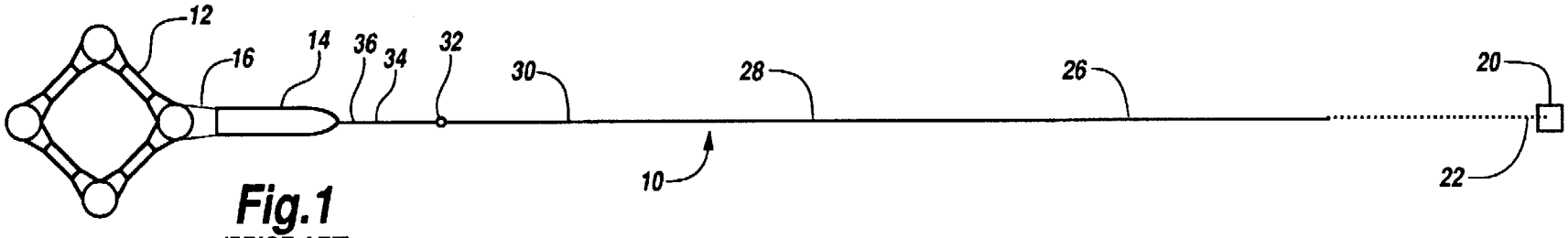
Fig.1 (PRIOR ART)
FIG. 1 is a plan view of a catenary-type mooring system.
Figure 2:
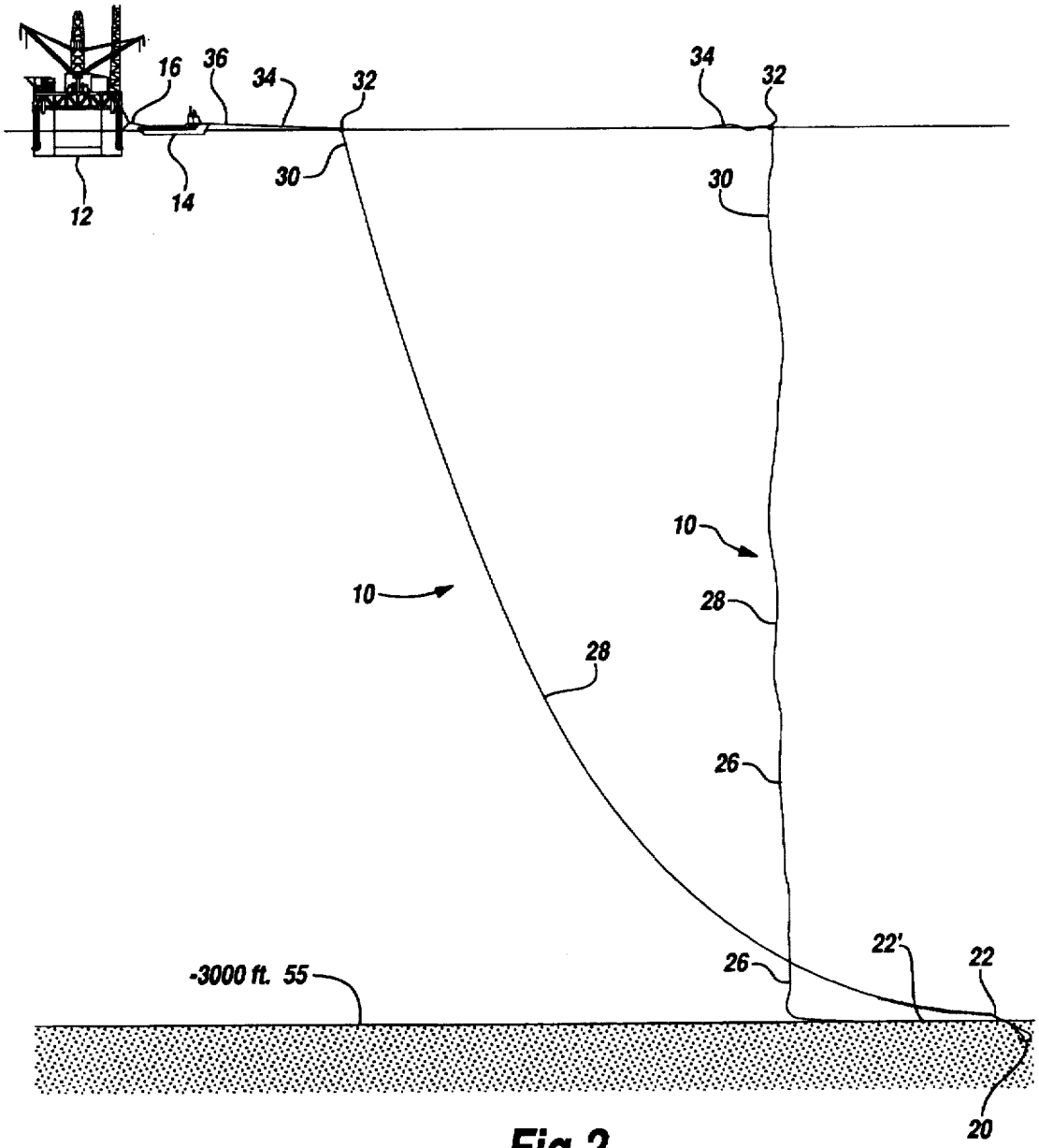
Fig.2 (PRIOR ART)
FIG. 2 is an elevation view of the catenary-type mooring system of FIG. 1.

Referring now to the Drawings, and particularly to FIGS. 1 and 2 thereof, there is shown a prior art catenary-type bow mooring system 10. An offshore drilling and/or production platform 12 is situated at a location in the sea where the water depth is approximately 3,000 feet or more. Goods and services are provided to the platform 12 and empty containers, trash and waste are removed from the platform 12 by means of supply boats 14 and similar vessels.

The vessels 14 are connected to the platform 12 utilizing the stern mooring apparatus 16. A catenary-type bow mooring system 10 is connected to the bow of the vessel 14, and is used to apply an outwardly directed force to the vessel 14 tending to pull the vessel 14 away from the platform 12. In theory, the bow mooring system 10 keeps the stern mooring apparatus 16 constantly in tension, thereby preventing engagement between the vessel 14 and the adjacent platform 12.

In actual practice, catenary-type mooring systems do not perform adequately, particularly in deep water applications. Catenary-type mooring systems lack adequate stiffness and therefore the outwardly directed force does not increase rapidly enough when environmental forces push the vessel toward the platform. In order to maintain adequate clearance it is necessary to operate the propulsion system of the moored vessel even in mild sea conditions in order to prevent inadvertent contact between the vessel and the adjacent structure.

Referring now to FIG. 2, the catenary-type mooring system 10 is shown in greater detail. A drag embedment anchor 20, of the type manufactured by Bruce, engages the sea floor. A 450 to 500-foot long, 3-inch diameter chain 22 is secured to and extends from the anchor 20. A 650-foot long, 2.5 inch diameter ground wire 26 is secured to and extends from the chain 22. A 2,700-foot long, 2-inch diameter riser wire 28 is secured to and extends from the ground wire 26. A 40-foot long, 2-inch diameter connection pendant wire 30 is secured to and extends from the riser wire 28.

An 85 kip net buoyancy surface buoy 32 is secured to the connection pendant wire 30 and floats on the surface of the sea. A 200-foot, 3-inch diameter hawser 34 is secured to and extends from the buoy 32. A bow mooring wire 36, having a length of about 200 feet and deployed from the vessel, interconnects the floating hawser 34 and the bow of the vessel 14. As indicted above, the stern mooring apparatus 16 interconnects the stern of the vessel 14 and the platform 12.

FIG. 2 also illustrates the catenary-type bow mooring system 10 when it is not connected to the vessel. As illustrated in the right-hand portion of FIG. 2, when the system is not in use a second difficulty inherent in the use of catenary-type mooring systems is that the surface buoy 32 is constantly in motion under the action of tides, waves, currents, etc. Movement of the buoy 32 causes flexure of the component parts of the mooring system 10, particularly the ground wire 26 near the sea floor. Since the components of the catenary-type mooring system 10 most subject to flexing are situated approximately 3,000 feet below the surface of the sea, it is therefore necessary to recover the mooring system 10 to the surface at approximately 12 to 24-month intervals in order to inspect the component parts thereof and replace any worn components.

Figure 3:
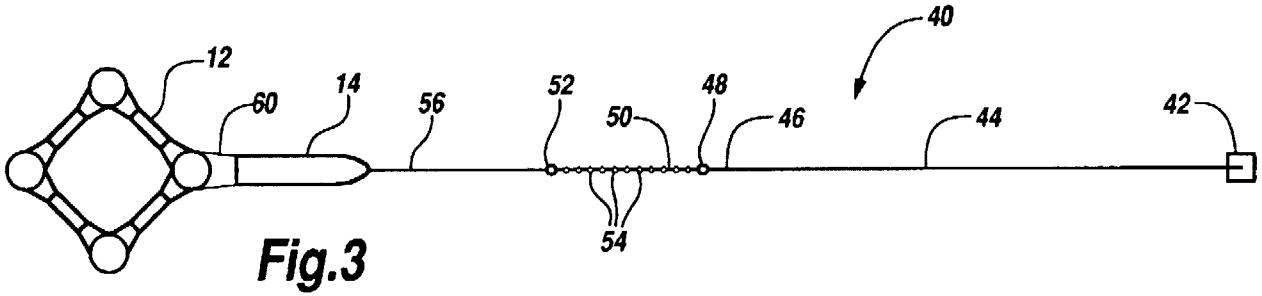
FIG. 3 is a plan view of a taut leg mooring system incorporating the preferred embodiment of the present invention.
Figure 4:
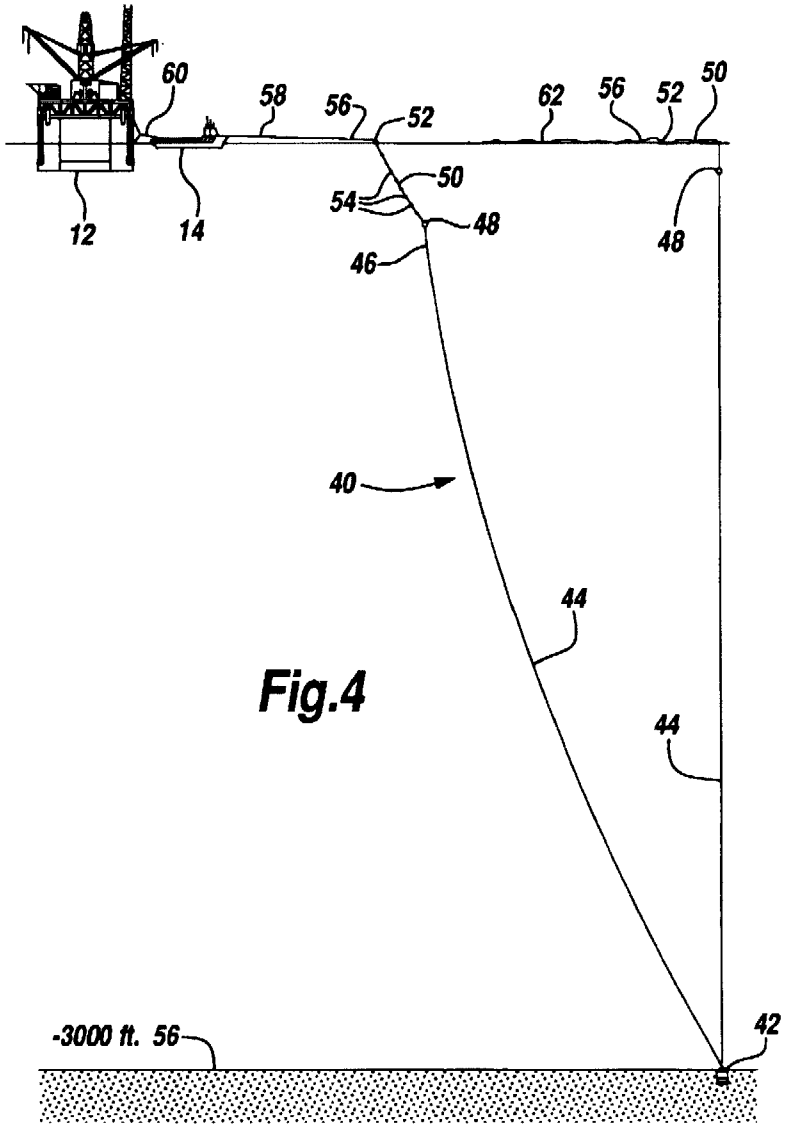
FIG. 4 is an elevation view of the taut leg mooring system of FIG. 3.
Figure 5:
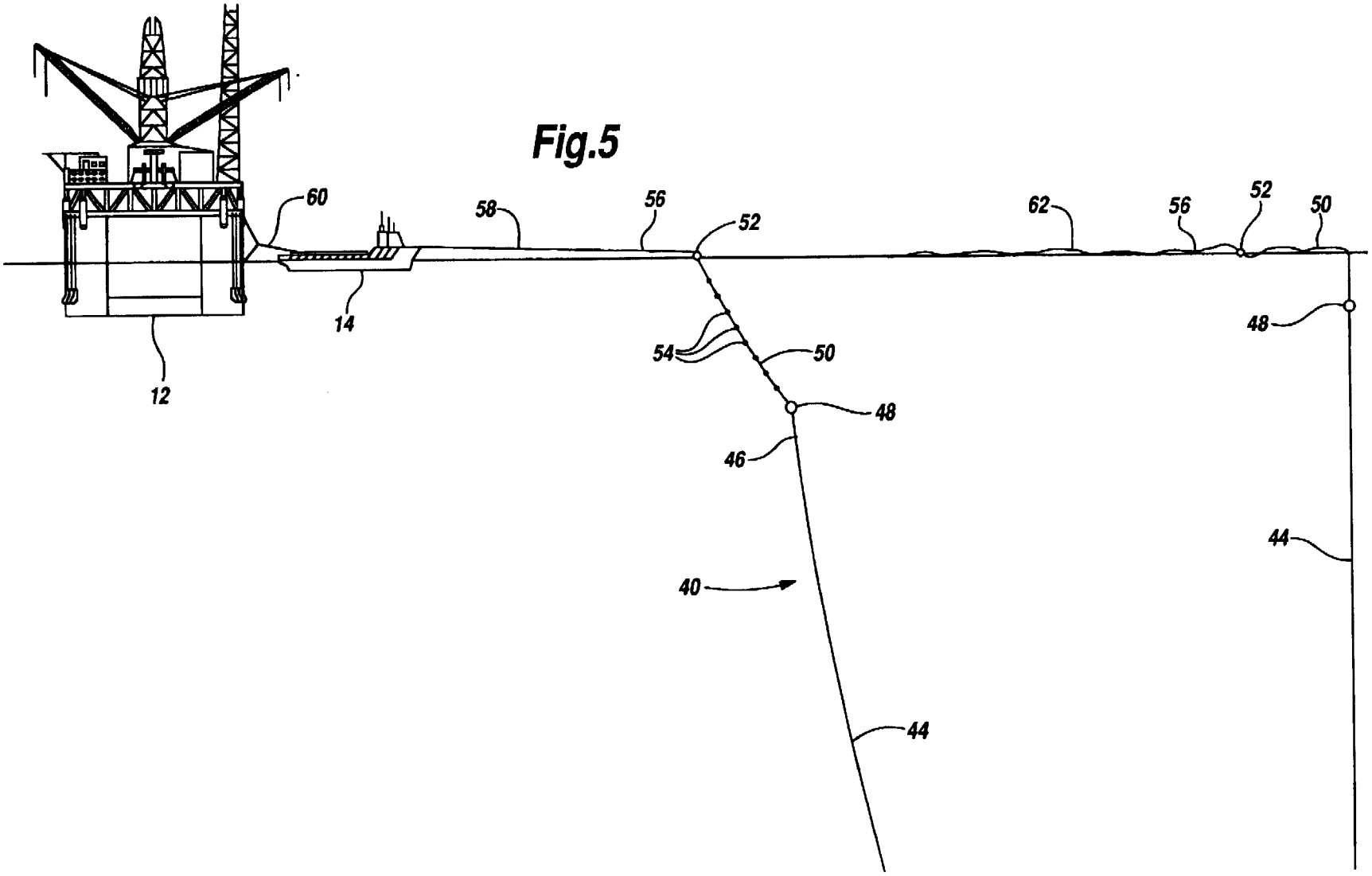
FIG. 5 is an enlargement of the upper portion of FIG. 4.

Referring now to FIGS. 3–5, a taut leg bow mooring system 40 incorporating the present invention is illustrated in use with a semi-submersible drilling and/or production platform 12 in approximately 3000 feet of water. It will be understood, however, that the system of the present invention may be used in varying water depths and with fixed and/or floating marine structures and/or vessels.

The system 40 includes a clump-weight anchor 42, which preferably comprises a steel tank filled with hematite ballast. In the embodiment shown, the anchor 42 has a submerged weight of between about 60 and about 75 tons. The weight of the anchor is determined by the maximum uplift loads of the system. Other anchors capable of sustaining a vertical load may be used in the practice of the invention in lieu of the clump-weight anchor 42, including suction anchors, anchor piles, and vertical loaded anchors.

A riser wire 44 is secured to and extends upwardly from the anchor 42. The riser wire 44 is approximately 2,885 feet in length and has a diameter of approximately 2.25 inches. The riser wire 44 may comprise a non-jacketed galvanized spiral strand wire rope equipped with zinc anode wires in the outer layer and internally filled with an amorphus polypropylene blocking compound. The service life for a riser wire of this type is between about 10 to about 15 years. Alternatively, the riser wire 44 may comprise galvanized spiral strand wire rope sheathed by a high density polyethylene jacket. Spiral strand wire rope having a high density polyethylene jacket is more expensive as compared with non-jacketed galvanized spiral strand wire rope equipped with anode wires, but has a service life of between about 20 to about 30 years. Still other options for use in the construction of the wire riser 44 comprise six-strand wire rope or synthetic rope. For example, the riser wire 44 could comprise a synthetic rope formed from high strength/low stretch aramid fibers, of the type available from DuPont under the trade name Kevlar™.

A 15-foot long, 3-inch diameter chain 46 and swivel is secured to and extends from the riser wire 44. A 45 kip net buoyancy submerged buoy 48 is secured to the chain 46. The submerged buoy 48 is sized to provide sufficient net buoyancy to keep the riser wire 44 of the mooring system in tension and in a substantially vertical position when not in use. For optimum performance to the system 40 the buoyancy of submerged buoy 48 is typically 10 to 20 kips in addition to the weight of the riser wire 44 and chain 46. The submerged buoy 48 comprises a drum formed from steel or from a body of synthetic material such as syntactic foam or a PVC foam with a protective cover. A floating connection line 50 extends between the submerged buoy 48 and a surface buoy 52. The line 50 may comprise a length of wire rope equipped with buoyancy collars 54 or, alternatively, the line 50 may comprise a length of 8-inch circumference buoyant synthetic line of high-strength/low stretch fiber of the type sold by Allied Fibers under the trademark SPECTRA™. Line of this type has a density such that it floats on the surface of salt water to minimize entanglement with the submerged buoy 48. A 300-foot, 10-inch circumference TQ12™ hawser 56, available from Bridon, is secured to and extends from the surface buoy 52.

The net buoyancy uplift of the surface buoy 52 is sized to prevent submergence of the surface buoy at the maximum vessel offset. It has been demonstrated that when the surface buoy becomes submerged, the stiffness in the system decreases dramatically. In the embodiment disclosed in FIGS. 3–5 the buoyancy of the surface buoy 52 is approximately 95 to 100 kips. Experimental data has demonstrated a ratio of the buoyancy of the surface buoy 52 to the buoyancy of the submerged buoy 48 of at least 2 to 1 produces optimum stiffness in the system 40. The surface buoy 52 comprises a polyurethane foam filled hollow steel drum or a polyurethane foam body with synthetic outer skin.

A 1.25 inch diameter bow wire 58 is connected between the hawser 56 and a winch on the bow of the vessel 14. A wishbone-type or other suitable stern mooring apparatus 60 is secured between the stern of the vessel 14 and the adjacent platform 12.

The performance of the taut leg bow mooring system 40 of the present invention under service conditions is vastly superior to that of the catenary-type bow mooring system illustrated in FIG. 2. Stiffness in a mooring system may be defined as the increase in bow mooring tension per unit of boat displacement, similar to the manner in which spring stiffness is defined. A typical catenary mooring system has a stiffness of approximately 150 lbs/ft. A taut leg mooring system of the present invention may have a stiffness of 450 lbs/ft or more. Therefore, the bow mooring system of the present invention provides an increased stiffness of between about 300 and 350 percent as compared with a corresponding catenary-type bow mooring system. Because of its significantly increased stiffness, the taut leg bow mooring system of the present invention provides a significantly improved outwardly directed force to the bow of the moored vessel of sufficient magnitude to maintain the stern mooring apparatus in tension, thereby preventing contact between the vessel and the adjacent structure without requiring the use of the vessel propulsion system in 6–8 foot sea conditions.

FIG. 4 also illustrates the taut leg bow mooring system when it is not connected to a vessel. As illustrated in the right-hand portion of FIG. 4, when the system 40 is not connected to a vessel, the riser wire 44 extends substantially vertically. The submerged buoy 48 is situated approximately 100 feet below the surface of the sea and is therefore not subject to wave action. Most of the connection line 50, the surface buoy 52 and the hawser 56 float on the surface of the sea awaiting connection to a vessel 14. A pick-up line 62 is normally secured to the hawser 56.

Because the submerged component parts of the taut leg mooring system 40 are oriented vertically and are always in tension when the system is not in use, the component parts thereof are not subject to flexure under the action of tides, waves, currents, etc. Therefore, the damaging wear at the sea floor, which is characteristic of catenary-type mooring systems, is not experienced in the use of taut leg mooring systems incorporating the present invention.

An additional advantage of the taut leg mooring system over the catenary mooring systems is illustrated in FIGS. 1 and 3. As can be seen a taut leg system positions the anchor 42 closer to the platform 12 than then anchor 20 is positioned to the platform 12. It is desirable to have the anchor as close as possible to the platform because it minimizes interference with pipelines on the sea floor. The fact that the taut leg mooring system only occupies a small area of the bottom (the anchor only) further minimizes pipeline interference problems. Additionally, when not in use, strong currents may displace the catenary system ground wire 26 and chain 22 along the bottom of the sea floor, carrying the surface buoy and hawser farther away from the platform. Therefore when a vessel to be moored attaches to the hawser it may have a substantially greater distance to back up toward the platform. As discussed above, with reference to the right-hand side of FIG. 4, when not in use the taut leg mooring system of the present invention is not displaced along the sea floor and therefore the surface buoy and hawser are not as subject to drift away from the platform.

Additionally, many semi-submersible and other types of floating platforms have a spread mooring system for the platforms themselves. These platform mooring systems may contain 8 to 12 and sometimes more mooring lines spread around the perimeter of the platform. As discussed above, catenary-type supply boat mooring systems are subject to drift. If the catenary mooring riser line drifts it may contact the platform mooring lines and cause damage to the platform mooring lines and/or the supply boat mooring line. Because the taut leg mooring system of the present invention is not subject to drift, the possibility for contact with the platform mooring lines is virtually eliminated.

Figure 6:
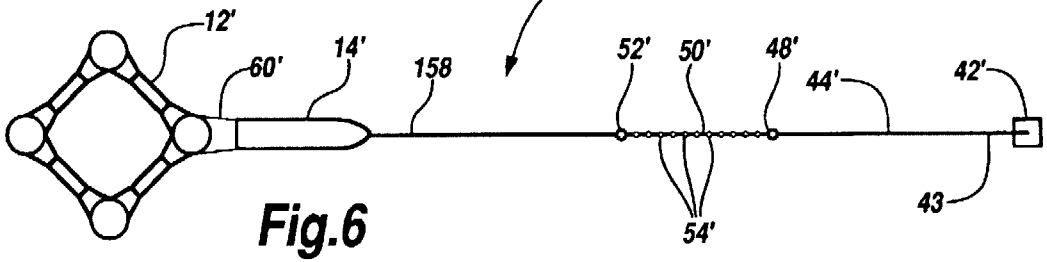
FIG. 6 is a plan view of a taut leg mooring system incorporating an alternative embodiment of the present invention.
Figure 7:
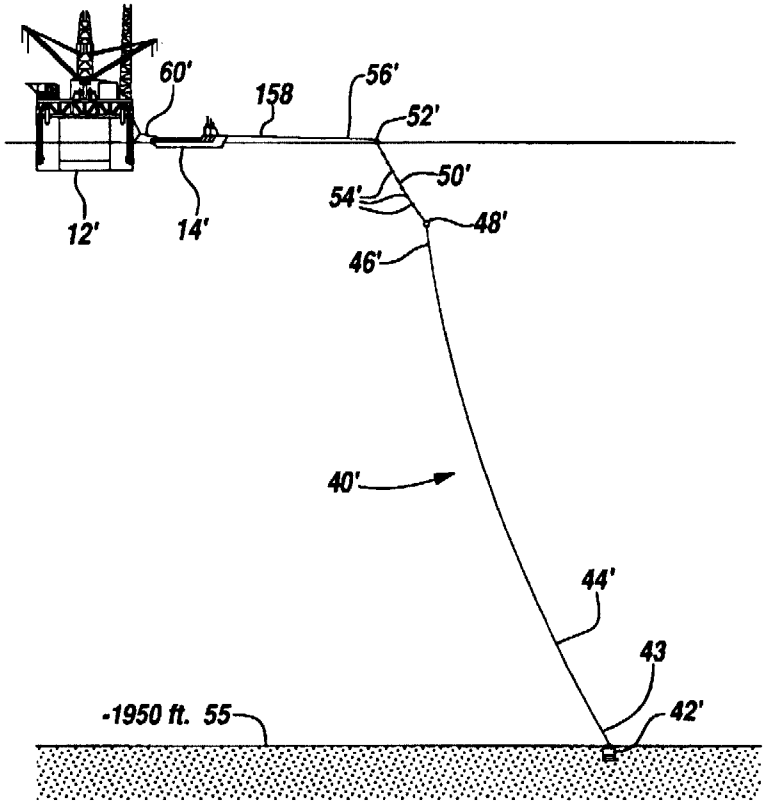
FIG. 7 is an elevation view of the alternative taut leg mooring system of FIG. 6.
Figure 8:
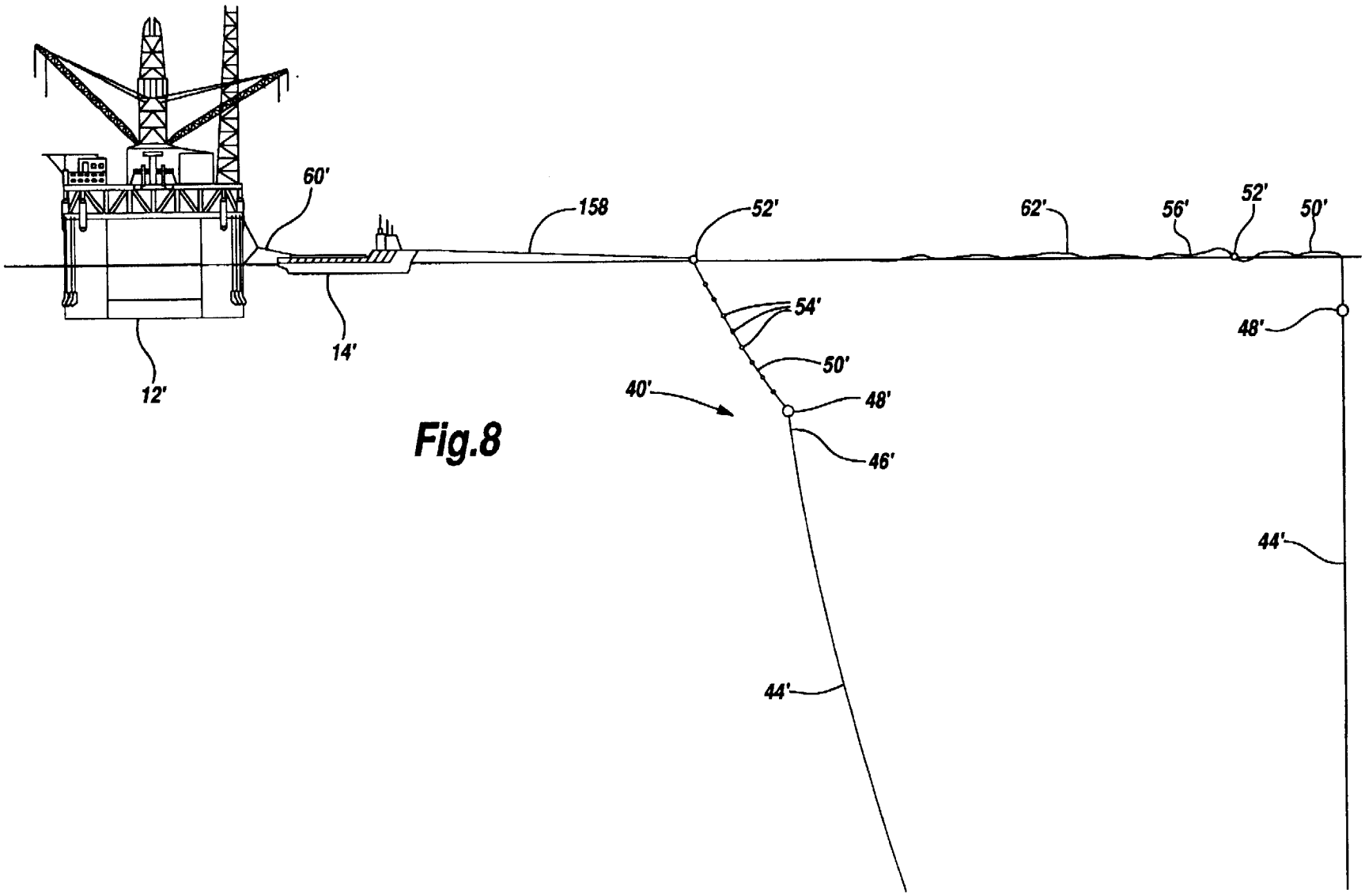
FIG. 8 is an enlargement of the upper portion of FIG. 7.

FIGS. 6–8 illustrate an alternative embodiment of the present invention illustrated in use with a semisubmersible drilling and/or production platform in approximately 1950 feet of water. It will be understood that the present invention may be used with a tension leg drilling and/or production platform and/or other type of moored or bottom supported offshore platforms.

The alternative embodiment incorporates many important parts of the preferred embodiment that are substantially identical in construction and function as those illustrated in FIGS. 3–5. Such identical component parts are designated in FIGS. 6–8 with the same reference numerals utilized hereinabove in the description of the preferred embodiment, but are differentiated by means of a prime (') designation. The system 40' includes a clump-weight anchor 42', which preferably comprises a steel tank filled with hematite ballast. In the embodiment shown, the anchor 42' preferably has a submerged weight of about 60 tons. Other anchors capable of sustaining a vertical load may be used in the practice of the invention in lieu of the clump-weight anchor 42', if desired.

A short length of 3-inch diameter chain 43 is secured to the anchor 42'. The chain 43 minimizes flexure in the riser wire 44'. The riser wire 44' is secured to and extends upwardly from the chain 43. The riser wire 44' is approximately 1,800 feet in length and has a diameter of approximately 2.125 inches. A short length, approximately 15-foot long, 2.5-inch diameter chain 46' is secured to and extends from the riser wire 44'. A 30 kip net buoyancy submerged buoy 48' is secured to the chain 46'. The submerged buoy 48' is sized to provide sufficient net buoyancy to maintain the riser wire in tension and in a substantially vertical position when not in use. For optimum performance of the system 40 the buoyancy of the submerged buoy is typically 10 to 20 kips in addition to the weight of the riser wire 44' chain 43 and chain 46'. A buoyant connection line 50' extends between the submerged buoy 48' and a surface buoy 52'. The line 50' may comprise a length of wire rope equipped with buoyancy collars 54'.

In the embodiment disclosed in FIGS. 6–8, the buoyancy of the surface buoy 52' is approximately 65 kips. Experimental data has demonstrated a ratio of the buoyancy of the surface buoy 52' to the buoyancy of the submerged buoy 48' of at least 2 to 1 produces optimum stiffness in the system.

A 300-foot, floating hawser 56' is secured to and extends from the surface buoy 52'. One hundred feet of boat anchor chain 158 is deployed from the vessel anchor windlass and connects the hawser 56' to the bow of the vessel 14'. A wishbone-type or other suitable stern mooring apparatus 60' is secured between the stern of the vessel 14' and the adjacent platform 12'.

FIG. 8 also illustrates the alternative taut leg bow mooring system 40' when it is not connected to a vessel. As illustrated in the right-hand portion of FIG. 8, when the system 40' is not connected to a vessel 14', the riser wire 44' extends substantially vertically. The submerged buoy 48' is situated approximately 100 feet below the surface of the sea and is, therefore, not subject to wave action. Most of the connection line 50', the surface buoy 52' and the hawser 56' float on the surface of the sea awaiting connection to a vessel 14'. A pick-up line 62' is normally secured to the hawser 56'.

Figure 9:
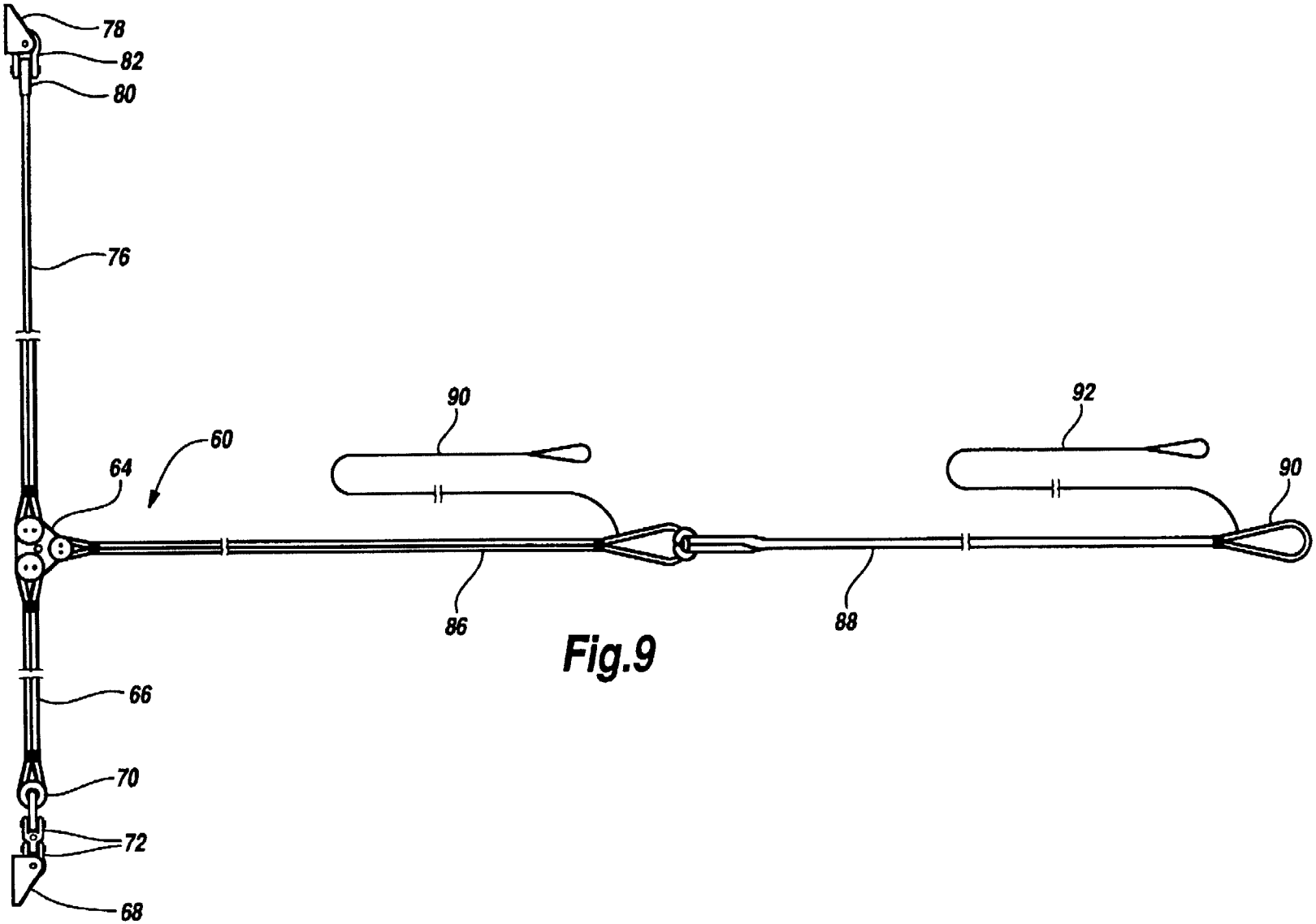
FIG. 9 is an illustration of a typical stern mooring system which may be used in conjunction with the present invention.

A suitable stern mooring apparatus 60 is illustrated in FIG. 9. The stern mooring apparatus 60 of FIG. 9 includes a triplet connector 64. A lower surge line 66 extends downwardly from the connector 64. The lower surge line 66 is connected to a fixture 68 welded to the platform 12 by an eye 70 and shackles 72.

An upper surge line 76 extends upwardly from the connector 64. The upper surge line 76 is connected to a fixture 78 welded to the platform 12 by an eye 80 and a shackle 82. A mooring line 86 also extends from the connector 64. A mooring tail 88 is secured to and extends from the mooring line 86. The mooring line 86 is provided with a recovery line 90, and the mooring tail 88 is provided with a crane pick-up line 92. It will be understood that other types of stern mooring apparatuses may be used in the practice of the invention if desired.

Although preferred and alternative embodiments of the invention have been illustrated in the accompanying Drawings and described in the foregoing Detailed Description, it will be understood that the invention is not limited to the embodiments disclosed, but is capable of numerous rearrangements and substitutions of parts and elements without departing from the spirit of the invention. Likewise it being understood, references herein to ocean or sea, are not meant to limit the invention to use in sea or marine environments, as the present invention is equally applicable to freshwater environments.

We claim:

1. A taut leg bow mooring system comprising:

an anchor having a total weight sufficient to remain fixed on the water body floor under predetermined maximum riser line tension, said anchor positionable on the sea floor;

a riser line secured to and extending from the anchor;

a submerged buoy secured to an upper end of the riser line, said submerged buoy positioned substantially below the surface of the water body both when the mooring system is connected to a vessel and when said mooring system is not connected to a vessel, said submerged buoy having a first predetermined buoyancy sufficient to maintain the riser line in tension and in a substantially vertical position when said mooring system is not connected to a vessel, thereby minimizing flexure wear of a lower portion of the riser line;

a floating connector line having a proximate end secured to the submerged buoy and extending therefrom; and a surface buoy positioned on the surface of the water and having a second predetermined buoyancy sufficient to prevent submergence of the surface buoy at a maximum vessel offset, said surface buoy secured to a distal end of the floating connector line remote from the submerged buoy, said surface buoy adapted to float on the surface of the water body.

2. The taut leg mooring system of claim 1 further including:

a hawser connected to and extending from a distal end of the connector line secured to the surface buoy, said hawser for connection to a vessel to be moored.

3. The taut leg mooring system of claim 1 further including:

a first length of chain positioned between the anchor and riser wire, said chain having a proximal end connected to the anchor and a distal end connected to the riser wire, wherein said chain reduces flexure in the riser wire.

4. The taut leg mooring system of claim 3 having a buoyancy of the submerged buoy around 10 to 20 kips above the combined weight of the riser line and first length of chain.

5. The taut leg mooring system of claim 1 further including:

a second length of chain positioned between the riser wire, and the submerged buoy, said chain having a proximal end connected to the riser wire and a distal end connected to the submerged buoy, wherein said chain reduces flexure in the riser wire.

6. The taut leg mooring system of claim 5 having a buoyancy of the submerged buoy around 10 to 20 kips above the combined weight of the riser line, the first length of chain and the second length of chain.

7. The taut leg mooring system of claim 1 having at least a 2 to 1 ratio of buoyancy of the surface buoy to the bouyancy of the submerged buoy.

8. The taut leg mooring system of claim 1 wherein the anchor has a submerged weight of between about 60 and about 75 tons.

9. The taut leg mooring system of claim 1 wherein the system has a stiffness factor of about 450 pounds per foot, said stiffness factor being defined as the increase in bow mooring tension per unit of boat displacement.

10. The taut leg mooring system of claim 1 wherein the submerged buoy is positioned about 100 feet below the surface of the water to isolate said submerged buoy and riser line from surface wave action.

11. A taut leg bow mooring system comprising:

an anchor having a total weight sufficient to remain fixed on the water body floor under predetermined maximum riser line tension, said anchor positionable on the sea floor;

a riser line secured to and extending from the anchor;

a submerged buoy secured to an upper end of the riser line, said submerged buoy positioned substantially below the surface of the water body both when the mooring system is connected to a vessel and when said mooring system is not connected to a vessel, said submerged buoy having a first predetermined buoyancy around 10 to 20 kips above the weight of the riser line, said first predetermined bouyancy sufficient to maintain the riser line in tension and in a substantially vertical position when said mooring system is not connected to a vessel;

a connector line having a proximate end secured to the submerged buoy and extending therefrom; and a surface buoy positioned on the surface of the water and having a second predetermined buoyancy sufficient to prevent submergence of the surface buoy at a maximum vessel offset, said surface buoy secured to a distal end of the connector line remote from the submerged buoy, said surface buoy adapted to float on the surface of the water body.

12. A taut leg bow mooring system comprising:

an anchor having a total weight sufficient to remain fixed on the water body floor under predetermined maximum riser line tension, said anchor positionable on the sea floor;

a riser line secured to and extending from the anchor;

a submerged buoy secured to an upper end of the riser line, said submerged buoy positioned substantially below the surface of the water body both when the mooring system is connected to a vessel and when said mooring system is not connected to a vessel, said submerged buoy having a first predetermined buoyancy sufficient to maintain the riser line in tension and in a substantially vertical position when said mooring system is not connected to a vessel;

a connector line having a proximate end secured to the submerged buoy and extending therefrom;

a surface buoy positioned on the surface of the water and having a second predetermined buoyancy sufficient to prevent submergence of the surface buoy at a maximum vessel offset, said surface buoy secured to a distal end of the connector line remote from the submerged buoy, said surface buoy adapted to float on the surface of the water body; and having a ratio of buoyancy of the surface buoy to the ratio of the bouyancy of the submerged buoy of at least 2 to 1.

13. A taut leg bow mooring system comprising:

an anchor having a total weight sufficient to remain fixed on the water body floor under predetermined maximum riser line tension, said anchor positionable on the sea floor;

a riser line secured to and extending from the anchor;

a submerged buoy secured to an upper end of the riser line, said submerged buoy positioned substantially below the surface of the water body both when the mooring system is connected to a vessel and when said mooring system is not connected to a vessel, said submerged buoy having a first predetermined buoyancy sufficient to maintain the riser line in tension and in a substantially vertical position when said mooring system is not connected to a vessel, thereby minimizing flexure wear of a lower portion of the riser line;

a floating connector line having a proximate end secured to the submerged buoy and extending therefrom; and a surface buoy positioned on the surface of the water and having a second predetermined buoyancy sufficient to prevent submergence of the surface buoy at a maximum vessel offset, said surface buoy secured to a distal end of the floating connector line remote from the submerged buoy, said surface buoy adapted to float on the surface of the water body.

14. The taut leg mooring system of claim 13 further including:

a hawser connected to and extending from the surface buoy, said hawser for connection to a vessel to be moored.

15. The taut leg mooring system of claim 13 wherein the anchor has a submerged weight of between about 60 and about 75 tons.

16. The taut leg mooring system of claim 13 wherein the anchor is a clump weight type anchor.

17. The taut leg mooring system of claim 13 further including:

a length of chain positioned between the anchor and riser wire, said chain having a proximal end connected to the anchor and a distal end connected to the riser wire, wherein said chain reduces flexure in the riser wire.

18. The taut leg mooring system of claim 13 further including:

a length of chain positioned between the riser wire and the submerged buoy, said chain having a proximal end connected to the riser wire and a distal end connected to the submerged buoy, wherein said chain reduces flexure in the riser wire.

19. The taut leg mooring system of claim 13 wherein the system has a stiffness factor of about 450 pounds per foot, said stiffness factor being defined as the increase in bow mooring tension per unit of boat displacement.

20. The taut leg mooring system of claim 13 wherein the submerged buoy is positioned about 100 feet below the surface of the water to isolate said submerged buoy and riser line from surface wave action.

* * * * *

UNITED STATES PATENT AND TRADEMARK OFFICE

CERTIFICATE OF CORRECTION

PATENT NO. : 5,704,307

DATED : January 6, 1998

INVENTOR(S) : Johannes Jacobus Treu and Peter George Scott Dove

It is certified that error appears in the above-identified patent and that said Letters Patent is hereby corrected as shown below:

Column 1, line 5, replace "March 21, 1996" with --March 13, 1996--.

Signed and Sealed this

First Day of September, 1998

*Attest:*

*Attesting Officer*

BRUCE LEHMAN

*Commissioner of Patents and Trademarks*